US007188822B2

(12) United States Patent
Marcichow et al.

(10) Patent No.: US 7,188,822 B2
(45) Date of Patent: Mar. 13, 2007

(54) ENCLOSURES FOR AUTOMATIC BATHROOM FLUSHERS

(75) Inventors: Martin E. Marcichow, Hoffman Estates, IL (US); Natan E. Parsons, Brookline, MA (US); Fatih Guler, Winchester, MA (US); Kay Herbert, Winthrop, MA (US)

(73) Assignees: Arichell Technologies, Inc., West Newton, MA (US); Sloan Valve Company, Franklin Park, IL (US)

( * ) Notice: Subject to any disclaimer, the term of this patent is extended or adjusted under 35 U.S.C. 154(b) by 0 days.

(21) Appl. No.: 10/783,701

(22) Filed: Feb. 20, 2004

(65) Prior Publication Data

US 2004/0227117 A1 Nov. 18, 2004

Related U.S. Application Data

(60) Provisional application No. 60/448,995, filed on Feb. 20, 2003.

(51) Int. Cl.
*F16K 31/12* (2006.01)

(52) U.S. Cl. ..... 251/30.01; 251/129.01

(58) Field of Classification Search .. 251/30.01–30.05, 251/45, 129.03, 129.04, 28; 4/302, 304, 4/305, 313, 406

See application file for complete search history.

(56) References Cited

U.S. PATENT DOCUMENTS

| | | | | |
|---|---|---|---|---|
| 207,482 | A | 8/1878 | Blessing | 137/188 |
| 1,501,331 | A | 7/1924 | Gulick | 137/245 |
| 2,619,122 | A | 11/1952 | Hunter | 251/120 |
| 2,619,986 | A | 12/1952 | Goepfrich et al. | 251/129.17 |
| 2,685,301 | A | 8/1954 | Dreier | 137/386 |
| 2,827,073 | A | 3/1958 | Owens | 137/426 |
| 2,842,400 | A | 7/1958 | Booth et al. | 239/569 |
| 2,877,791 | A | 3/1959 | Rich | 137/487 |
| 2,923,314 | A | 2/1960 | Badger, Jr. et al. | 137/414 |
| 2,986,155 | A | 5/1961 | Doyle | 137/218 |
| 2,999,191 | A | 9/1961 | Muradian et al. | 361/195 |
| 3,019,453 | A | 2/1962 | Radcliffe | 4/249 |
| 3,034,151 | A | 5/1962 | Filliung | 4/249 |
| 3,056,143 | A | 10/1962 | Foster | 4/249 |
| 3,058,485 | A | 10/1962 | McQueen | 137/403 |
| 3,098,635 | A | 7/1963 | Delaporte et al. | 251/54 |
| 3,242,940 | A | 3/1966 | Sirotek | 137/218 |
| 3,254,664 | A | 6/1966 | Delaney et al. | 137/244 |
| 3,318,565 | A | 5/1967 | Culter | 251/45 |
| 3,369,205 | A | 2/1968 | Hamrick | 335/177 |
| 3,373,449 | A | 3/1968 | Rusnok | 4/305 |
| 3,386,462 | A | 6/1968 | Walters | 137/244 |

(Continued)

*Primary Examiner*—Justine Yu
(74) *Attorney, Agent, or Firm*—Ivan David Zitkovsky

(57) ABSTRACT

A bathroom flusher includes a flusher body, a valve assembly, an electronic control system, and a flusher cover. The flusher body includes an inlet and an outlet, and is designed to accommodate the valve assembly that controls water flow between the inlet and the outlet. The valve assembly includes a valve member movable with respect to a valve seat providing a sealing action based on applied pressure on the valve assembly. The bathroom flusher also includes an external cover designed for enclosing an electronic control module comprising a battery, a sensor, and an actuator for controlling operation of the flush valve, wherein the external cover includes at least two cover parts separately removable, and wherein the external cover is attachable with respect to the valve body in a manner also allowing removable attachment of the control module.

25 Claims, 10 Drawing Sheets

U.S. PATENT DOCUMENTS

| | | | | |
|---|---|---|---|---|
| 3,400,731 | A | 9/1968 | McCormack | 137/245 |
| 3,495,803 | A | 2/1970 | Schoepe et al. | 251/25 |
| 3,495,804 | A | 2/1970 | Muller et al. | 251/36 |
| 3,559,675 | A | 2/1971 | Schoepe et al. | 137/436 |
| 3,606,241 | A | 9/1971 | Bornholdt | 251/52 |
| 3,693,649 | A | 9/1972 | Gordon et al. | 137/414 |
| 3,740,019 | A | 6/1973 | Kessell et al. | 251/129.17 |
| 3,763,881 | A | 10/1973 | Jones | 137/414 |
| 3,778,023 | A | 12/1973 | Billeter | 251/30.01 |
| 3,791,619 | A | 2/1974 | Pett | 251/45 |
| 3,802,462 | A | 4/1974 | Trösch | 137/556 |
| 3,812,398 | A | 5/1974 | Kozel et al. | 251/331 |
| 3,821,967 | A | 7/1974 | Sturman | 137/624.15 |
| 3,842,857 | A | 10/1974 | McCormack | 137/242 |
| 3,895,645 | A | 7/1975 | Johnson | 137/403 |
| 4,010,769 | A | 3/1977 | De Lorenzo et al. | 137/312 |
| 4,065,095 | A | 12/1977 | Johnson | 251/118 |
| 4,097,786 | A | 6/1978 | Lund | 318/282 |
| 4,105,186 | A | 8/1978 | Eby | 251/35 |
| 4,135,696 | A | 1/1979 | Saarem et al. | 251/30.02 |
| 4,141,091 | A | 2/1979 | Pulvari | 4/313 |
| 4,206,901 | A | 6/1980 | Williams | 251/35 |
| 4,231,287 | A | 11/1980 | Smiley | 92/94 |
| 4,272,052 | A | 6/1981 | Gidner | 251/39 |
| 4,280,680 | A | 7/1981 | Payne | 251/175 |
| 4,295,485 | A | 10/1981 | Waterfield | 137/74 |
| 4,295,631 | A | 10/1981 | Allen | 251/30.03 |
| 4,295,653 | A | 10/1981 | Coles | 277/320 |
| 4,304,391 | A | 12/1981 | Yamaguchi | 251/129.05 |
| 4,309,781 | A | 1/1982 | Lissau | 4/304 |
| 4,383,234 | A | 5/1983 | Yatsushiro et al. | 335/253 |
| 4,505,451 | A | 3/1985 | Jonas | 251/285 |
| 4,570,272 | A | 2/1986 | Kawaguchi et al. | 4/302 |
| 4,604,735 | A | 8/1986 | Parsons | 367/93 |
| 4,609,178 | A | 9/1986 | Baumann | 251/229 |
| 4,611,356 | A | 9/1986 | Lin | 4/301 |
| 4,709,427 | A | 12/1987 | Laverty, Jr. | 4/427 |
| 4,729,342 | A | 3/1988 | Loctin | 119/163 |
| 4,756,031 | A | 7/1988 | Barrett | 4/407 |
| 4,787,411 | A | 11/1988 | Moldenhauer | 137/244 |
| 4,793,588 | A | 12/1988 | Laverty, Jr. | 251/30.03 |
| 4,796,662 | A | 1/1989 | Hoffmann et al. | 137/596.16 |
| 4,805,247 | A | 2/1989 | Laverty, Jr. | 4/304 |
| 4,823,414 | A | 4/1989 | Piersimoni et al. | 4/623 |
| 4,823,825 | A | 4/1989 | Buchl | 137/1 |
| 4,826,132 | A | 5/1989 | Moldenhauer | 251/129.17 |
| 4,832,582 | A | 5/1989 | Buffet | 417/413.1 |
| 4,839,039 | A | 6/1989 | Parsons et al. | 210/143 |
| 4,891,864 | A | 1/1990 | Laverty, Jr. | 91/399 |
| 4,893,645 | A | 1/1990 | Augustinas et al. | 137/315.03 |
| 4,894,698 | A | 1/1990 | Hijikigawa et al. | 257/254 |
| 4,894,874 | A | 1/1990 | Wilson | 4/623 |
| 4,910,487 | A | 3/1990 | Kleinhappl | 335/234 |
| 4,911,401 | A | 3/1990 | Holcomb et al. | 251/30.03 |
| 4,921,208 | A | 5/1990 | LaMarca | 251/30.04 |
| 4,921,211 | A | 5/1990 | Novak et al. | 251/129.04 |
| 4,932,430 | A | 6/1990 | Fernstrom | 137/85 |
| 4,941,215 | A | 7/1990 | Liu | 4/406 |
| 4,941,219 | A | 7/1990 | Van Marcke | 4/623 |
| 4,944,487 | A | 7/1990 | Holtermann | 251/129.17 |
| 4,977,929 | A | 12/1990 | Chinnock et al. | 137/863 |
| 4,988,074 | A | 1/1991 | Najmolhoda | 251/129.08 |
| 4,989,277 | A * | 2/1991 | Tsutsui et al. | 4/367 |
| 4,998,673 | A | 3/1991 | Pilolla | 239/67 |
| 5,025,516 | A | 6/1991 | Wilson | 4/623 |
| 5,027,850 | A | 7/1991 | Peterson et al. | 137/245 |
| 5,032,812 | A | 7/1991 | Banick et al. | 335/17 |
| 5,036,553 | A | 8/1991 | Sanderson | 4/313 |
| 5,074,520 | A | 12/1991 | Lee et al. | 251/40 |
| 5,109,886 | A | 5/1992 | Takata et al. | 137/596.17 |
| 5,125,621 | A | 6/1992 | Parsons et al. | 251/30.03 |
| 5,127,625 | A | 7/1992 | Kleinhappl | 251/129.17 |
| 5,169,118 | A | 12/1992 | Whiteside | 251/30.03 |
| 5,188,337 | A | 2/1993 | Mertens et al. | 251/129.17 |
| 5,195,720 | A | 3/1993 | Nortier et al. | 251/129.04 |
| 5,213,303 | A | 5/1993 | Walker | 251/30.02 |
| 5,213,305 | A | 5/1993 | Whiteside et al. | 251/40 |
| 5,224,685 | A | 7/1993 | Chiang et al. | 251/129.04 |
| 5,232,194 | A | 8/1993 | Saadi et al. | 251/40 |
| 5,244,179 | A | 9/1993 | Wilson | 251/30.03 |
| 5,251,188 | A | 10/1993 | Parsons et al. | 367/140 |
| 5,265,594 | A | 11/1993 | Olsson et al. | 128/204.18 |
| 5,265,843 | A | 11/1993 | Kleinhappl | 251/129.17 |
| 5,295,655 | A | 3/1994 | Wilson et al. | 251/40 |
| 5,313,673 | A | 5/1994 | Saadi et al. | 4/313 |
| 5,315,719 | A | 5/1994 | Tsutsui et al. | 4/300 |
| 5,335,694 | A | 8/1994 | Whiteside | 137/625.37 |
| 5,375,811 | A | 12/1994 | Reinicke | 251/129.16 |
| D354,113 | S | 1/1995 | Nortier et al. | D23/233 |
| D355,478 | S | 2/1995 | Allen et al. | D23/249 |
| D357,976 | S | 5/1995 | Allen et al. | D23/249 |
| 5,412,816 | A | 5/1995 | Paterson et al. | 4/623 |
| 5,431,181 | A | 7/1995 | Saadi et al. | 137/15.11 |
| 5,433,245 | A | 7/1995 | Prather et al. | 137/554 |
| 5,456,279 | A | 10/1995 | Parsons et al. | 137/245 |
| 5,474,303 | A | 12/1995 | Coles | 277/317 |
| 5,481,187 | A | 1/1996 | Marcott et al. | 324/207.16 |
| 5,508,510 | A | 4/1996 | Laverty, Jr. et al. | 250/221 |
| 5,548,119 | A | 8/1996 | Nortier | 250/341.1 |
| 5,555,912 | A | 9/1996 | Saadi et al. | 137/801 |
| 5,566,702 | A | 10/1996 | Philipp | 137/1 |
| 5,574,617 | A | 11/1996 | Shimanuki et al. | 361/154 |
| 5,583,434 | A | 12/1996 | Moyers et al. | 324/207.16 |
| 5,584,465 | A | 12/1996 | Ochsenreiter | 251/65 |
| 5,600,237 | A | 2/1997 | Nippert | 324/207.16 |
| 5,636,601 | A | 6/1997 | Moriya et al. | 123/90.11 |
| 5,668,366 | A | 9/1997 | Mauerhofer | 250/221 |
| 5,680,879 | A | 10/1997 | Sheih et al. | 137/240 |
| 5,708,355 | A | 1/1998 | Schrey | 323/282 |
| 5,716,038 | A | 2/1998 | Scarffe | 251/30.03 |
| 5,747,684 | A | 5/1998 | Pace et al. | 73/119 A |
| D396,090 | S | 7/1998 | Marcichow et al. | D23/233 |
| 5,787,915 | A | 8/1998 | Byers et al. | 137/1 |
| 5,787,924 | A | 8/1998 | Cewers et al. | 137/487.5 |
| 5,797,360 | A | 8/1998 | Pischinger et al. | 123/90.11 |
| 5,804,962 | A | 9/1998 | Kather et al. | 324/207.16 |
| 5,815,362 | A | 9/1998 | Kahr et al. | 361/153 |
| 5,819,336 | A | 10/1998 | Gilliam et al. | 4/623 |
| 5,881,993 | A | 3/1999 | Wilson et al. | 251/40 |
| 5,887,848 | A | 3/1999 | Wilson | 251/40 |
| 5,901,384 | A | 5/1999 | Sim | 4/313 |
| 5,905,625 | A | 5/1999 | Schebitz | 361/154 |
| 5,941,505 | A | 8/1999 | Nagel | 251/335.2 |
| 5,950,983 | A | 9/1999 | Jahrling | 251/129.04 |
| 5,964,192 | A | 10/1999 | Ishii | 123/90.11 |
| 5,967,182 | A | 10/1999 | Wilson | 137/544 |
| 5,979,500 | A | 11/1999 | Jahrling et al. | 137/624.12 |
| 5,984,262 | A | 11/1999 | Parsons et al. | 251/129.04 |
| 5,996,965 | A | 12/1999 | Eichholz et al. | 251/30.05 |
| 6,000,674 | A | 12/1999 | Cheng | 251/26 |
| 6,024,059 | A | 2/2000 | Kamimaru et al. | 123/90.11 |
| 6,044,814 | A | 4/2000 | Fuwa | 123/90.11 |
| 6,056,261 | A | 5/2000 | Aparicio et al. | 251/129.03 |
| 6,127,671 | A | 10/2000 | Parsons et al. | 250/221 |
| 6,155,231 | A | 12/2000 | Adachi et al. | 123/399 |
| 6,158,715 | A | 12/2000 | Kirschbaum | 251/129.06 |
| 6,161,726 | A | 12/2000 | Parsons et al. | 222/52 |
| 6,182,689 | B1 | 2/2001 | Lauer et al. | 137/550 |
| 6,212,697 | B1 | 4/2001 | Parsons et al. | 4/302 |
| 6,216,730 | B1 | 4/2001 | Hall | 137/550 |
| 6,227,219 | B1 | 5/2001 | Pino | 137/1 |
| 6,243,885 | B1 * | 6/2001 | Lopez-Torres, Jr. | 4/300 |
| 6,260,576 | B1 | 7/2001 | Allen | 137/550 |
| 6,273,394 | B1 | 8/2001 | Vincent et al. | 251/129.04 |

6,293,516 B1 9/2001 Parsons et al. ..... 251/129.04
6,299,127 B1 10/2001 Wilson ..... 251/38
6,305,662 B1 10/2001 Parsons et al. ..... 251/129.04
6,340,032 B1 1/2002 Zosimadis ..... 137/552
6,353,942 B1 3/2002 Pondelick et al. ..... 4/431
6,367,096 B1 4/2002 Quintana ..... 4/427
6,382,586 B1 5/2002 Wilson et al. ..... 251/40
6,450,478 B2 9/2002 Parsons et al. ..... 251/129.04
6,499,152 B2 * 12/2002 Johnson ..... 4/302
6,609,698 B1 8/2003 Parsons et al. ..... 251/129.17
6,619,614 B2 9/2003 Parsons et al. ..... 251/129.04
6,643,853 B2 11/2003 Wilson et al. ..... 4/249
6,685,158 B2 2/2004 Parsons ..... 251/30.01

* cited by examiner

ENCLOSURES FOR AUTOMATIC BATHROOM FLUSHERS

This application claims priority from U.S. Provisional application 60/448,995, filed on Feb. 20, 2003, which is incorporated by reference.

FIELD OF THE INVENTION

The present inventions are directed to automatic bathroom flushers having modular design and methods of operating and servicing such flushers. The present inventions are also directed to a novel flusher cover enabling easy servicing and adjustments and optional optimal operation.

BACKGROUND OF THE INVENTION

Automatic bathroom flushers have become increasingly prevalent, particularly in public restrooms, both for flushing toilets and urinals. Such flushers contribute to hygiene, facility cleanliness and water conservation.

There are several types of tankless bathroom flushers on the market including flushers supplied by Sloan Valve Company, for example, sold as ROYAL® or GEM® flush valves. ROYAL® flush valves may be manually operated, or automatically operated using OPTIMA® controllers and infrared sensors. In general, bathroom flushers receive a pressurized water supply at an input and provide flush water at an output during a flush cycle. The flush cycle provides a predetermined amount of water (depending on the external water pressure) even though there is no water tank.

In manual flushers, users initiate a flushing cycle by displacing a handle that controls a flushing mechanism including a piston or a flexible diaphragm. The handle movement causes a water leak from a control or pilot chamber to the flusher's output, which lowers pressure in the pilot chamber. Due to the lower pressure, the external water pressure lifts the flusher's piston or diaphragm from a valve seat thereby enabling water flow. The stroke of the piston or diaphragm controls the volume of water passing through the flush valve. After some time, the pressure in the pilot chamber increases (through a control passage) forcing the piston or diaphragm onto the valve seat and thus terminating the water flow.

In automatic flushers, an object sensor initiates the flushing cycle, where an actuator opens a relief passage enabling water flow from the pilot chamber to the flusher's output. This flow lowers pressure in the pilot chamber. Due to the lower pressure, as mentioned above, the external pressure lifts the flusher's piston or diaphragm from a valve seat thereby enabling main water flow used for flushing. After the actuator seals the relief passage, the pressure in the pilot chamber increases forcing the piston or diaphragm onto the valve seat and thus closing the water flow. Manual flush valves (e.g., ROYAL® flush valves) may be converted into automatically operated valves using a controller and sensor unit, sold under the name OPTIMA® by Sloan Valve Company. Overall, the flush valves supplied by Sloan Valve Company are durable, highly reliable, and suitable for long-term operation.

There is, however, a need for improved automatic flushers due to a high demand for flushers and their need in thousands of restrooms.

SUMMARY OF THE INVENTION

The described inventions are directed to automatic bathroom flushers having modular design, and methods for operating and servicing such flushers. The present inventions are also directed to a novel flusher cover enabling easy servicing and adjustments and optional optimal operation.

According to one aspect, the present invention is a bathroom flusher. The bathroom flusher includes a flusher body, a valve assembly, an electronic control system, and a flusher cover. The flusher body includes an inlet and an outlet, and is designed to accommodate the valve assembly that controls water flow between the inlet and the outlet. The valve assembly includes a valve member movable with respect to a valve seat providing a sealing action based on applied pressure on the valve assembly.

According to another aspect, an automatic toilet room flush valve includes a valve body having an inlet and an outlet, and a valve seat inside the body. The flush valve also includes a valve member (i.e., a flush valve mechanism) and an external cover. The valve member is cooperatively arranged with the valve seat, wherein the valve member is constructed and arranged to control water flow between the inlet and the outlet. The movement of the valve member between open and closed positions is controlled by water pressure inside a pilot chamber. The external cover is designed for enclosing an electronic control module comprising a battery, a sensor, and an actuator for controlling operation of the flush valve, wherein the external cover includes at least two cover parts separately removable, and the external cover is attachable with respect to the valve body in a manner also allowing removable attachment of the control module.

Preferred embodiments of the above aspects include one or more of the following features: The external cover includes main cover body, a front cover and a top cover. The front cover includes an optical window, wherein the sensor is an optical sensor geometrically aligned with the optical window. The main cover body provides overall rigidity to the external cover. The individual cover parts of the external cover enable separate servicing and replacement of the cover parts.

The sensor may be an optical sensor and the sensor window is an optical window. Alternatively, the sensor includes an ultrasonic sensor or a heat sensor designed to detect body heat. Alternatively, the sensor is a near-infrared sensor that detects optical radiation in the range of about 800 nm to about 1500 nm. Alternatively, the sensor is a presence sensor. Alternatively, the sensor is a motion sensor.

The top cover is removable while maintaining the front cover, including a sensor window located in place with respect to the main cover body. The flush valve is further constructed to adjust detection sensitivity of the sensor while maintaining the optical window located on the main cover body.

The top cover may include at least one side surface designed for facilitating removal of the top cover. The top cover is attached with respect to the valve body using at least one screw, wherein tightening of the at least one screw attaches the main cover body, the front cover, and the top cover to a pilot cap defining the pilot chamber and attached to the valve body.

The external cover may include a vent passage for venting water from inside the external cover. The top cover includes a button constructed to move between upper and lower positions and designed for manually triggering a flush cycle when pushed to the lower position. The movable button includes a magnet co-operatively arranged with a reed sensor capable of providing a signal to a microcontroller.

The flush valve further includes a removable element (such as a plastic strip, a pin, or a tape) designed for shipping and storage, wherein the removable element is positioned to retain the button in the lower position when assembling the top cover.

The flush valve may include a piston, or a flexible diaphragm. The flexible diaphragm includes a centrally located passage connecting the relief passage and the outlet, wherein the flexible diaphragm is retained with respect to the valve body by a pressure cap defining the pilot chamber. The flush valve may include a bypass orifice in the diaphragm connecting the inlet with the pressure chamber, the orifice having a cross section area smaller than that of the passage.

According to yet another aspect, in an automatic toilet flush valve including a body having an inlet, an outlet, and a valve assembly in the body constructed and arranged to open and close water flow from the inlet to the outlet upon actuation signals provided by an electronic system to an actuator. The automatic flush valve includes a pressure cap defining a pilot chamber in communication with the output via a relief passage controlled by the actuator receiving drive signals from the electronic system. An external cover is mounted next to the pressure cap and is constructed to provide housing for the electronic system. The cover includes an external flow passage for water flow from inside to outside of the cover.

According to yet another aspect, in an automatic toilet flush valve including a body having an inlet and an outlet, there is a valve assembly located in the body and constructed and arranged to open and close water flow from the inlet to the outlet upon actuation signals provided by an electronic system to an actuator. The automatic flush valve includes a pressure cap defining a pilot chamber in communication with the output via a relief passage controlled by the actuator. The automatic flush valve also includes a sensor, as part of the electronic system, constructed to detect a user located in front of the flush valve and designed to provide control signals to the electronic system, the electronic system being constructed to provide drive signals to the actuator. An external cover is mounted above the pressure cap and is constructed to provide housing for the electronic system. The external cover is designed cooperatively with the electronic system to enable sensitivity adjustment of the sensor without removal of the cover's sensor window.

Preferred embodiments of the above aspects include one or more of the following features: The sensor includes an infrared sensor or an ultrasonic sensor or a heat sensor. The sensor includes a presence sensor or a motion sensor.

The cover is mounted above the pressure cap. The valve assembly includes a flexible diaphragm fixed relative to the pressure cap, wherein the valve assembly includes a vent passage in the flexible diaphragm in communication with the pilot chamber, being controllably sealable by the actuator.

The vent passage includes a flexible member extending between a pilot chamber cap and the vent passage in the flexible diaphragm, wherein the flexible member includes a seal remaining stationary during movement of the flexible diaphragm between open and closed positions of the flush valve. The flexible member is a hollow tube. The hollow tube may include a spring positioned therein. The spring may be a coiled wire.

The actuator may be an isolated actuator. The valve assembly may include a filter for filtering water passing toward the actuator. The filter may be attached to the flexible diaphragm.

According to yet another aspect, a method for converting a manually operated flush valve to an automatic flush valve includes providing a manually operated flush valve including a flush valve mechanism located within a valve body constructed and arranged to control water flow between a water inlet and a water outlet, a manual handle mechanically coupled to the valve mechanism and constructed to operate the valve mechanism upon pivotable displacement. The method also includes closing an external water supply to the valve body, removing the manual handle and sealing a manual handle port, and removing an external cover above the valve body, wherein the external cover retained the flush valve mechanism. Then, the method includes attaching to the body an external cover that includes at least two separately removable cover parts, where the external cover is attachable to the valve body by attaching the removable control module and opening the external water supply to enable water flow to the valve body.

Preferably, the method includes subsequently adjusting the sensitivity of the sensor while maintaining the optical window of the cover in place, as designed for standard operation.

According to yet another aspect, a method for servicing an automatic toilet room flush valve includes providing an automatic toilet room flush valve including a valve body having an inlet and an outlet; a valve seat inside the body; a valve member cooperatively arranged with the valve seat, the valve member being constructed and arranged to control water flow between the inlet and the outlet, movement of the valve member between open and closed positions being controlled by water pressure inside a pilot chamber; and an external cover designed for enclosing a battery, a sensor and an actuator for controlling operation of the flush valve. The servicing method then includes removing a portion of the external cover while maintaining in place a sensor window included in the external cover, wherein the sensor window is cooperatively arranged with the sensor and adjusting sensitivity of the sensor while maintaining the sensor window in place as designed for regular operation.

DETAILED DESCRIPTION OF ILLUSTRATED EMBODIMENTS

Figure 1B:
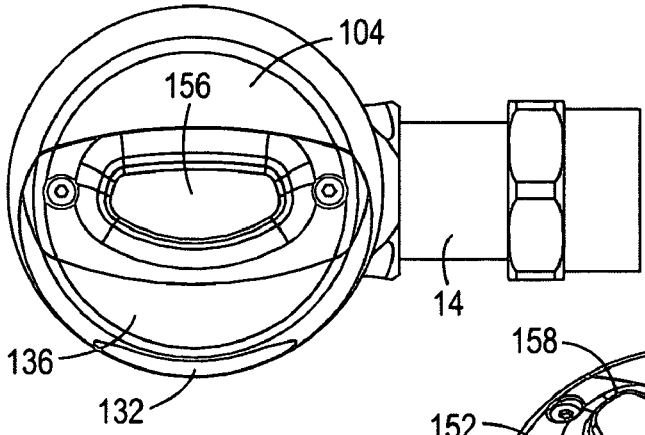
FIGS. 1A and 1B are a front view and a top view of the bathroom flusher shown in FIG. 1, respectively.
Figure 1:
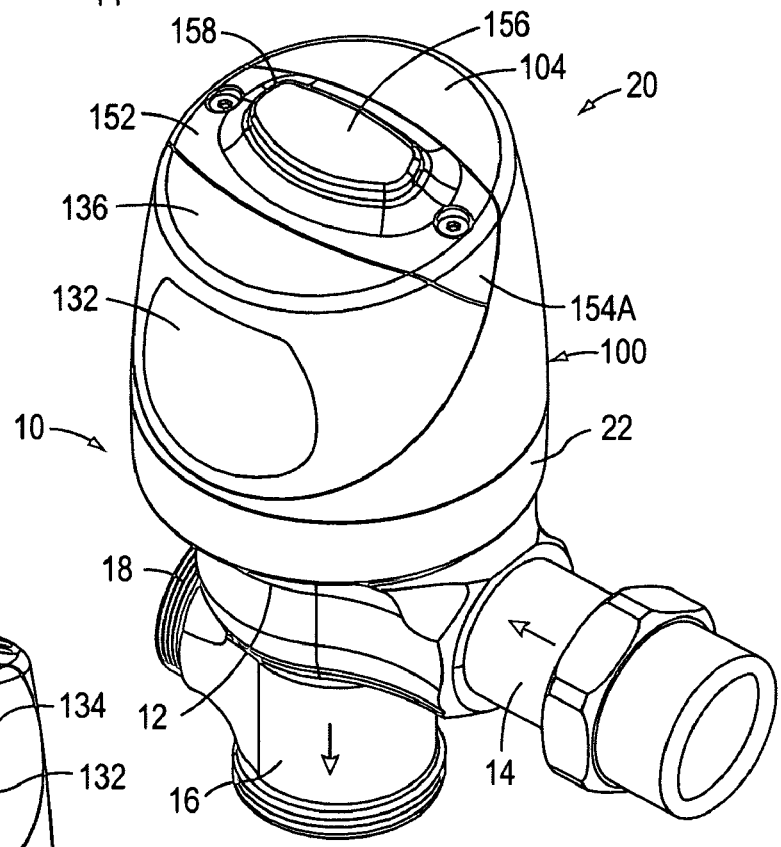
FIG. 1 is a perspective view of an automatic bathroom flusher used for flushing a toilet or a urinal.
Figure 1A:
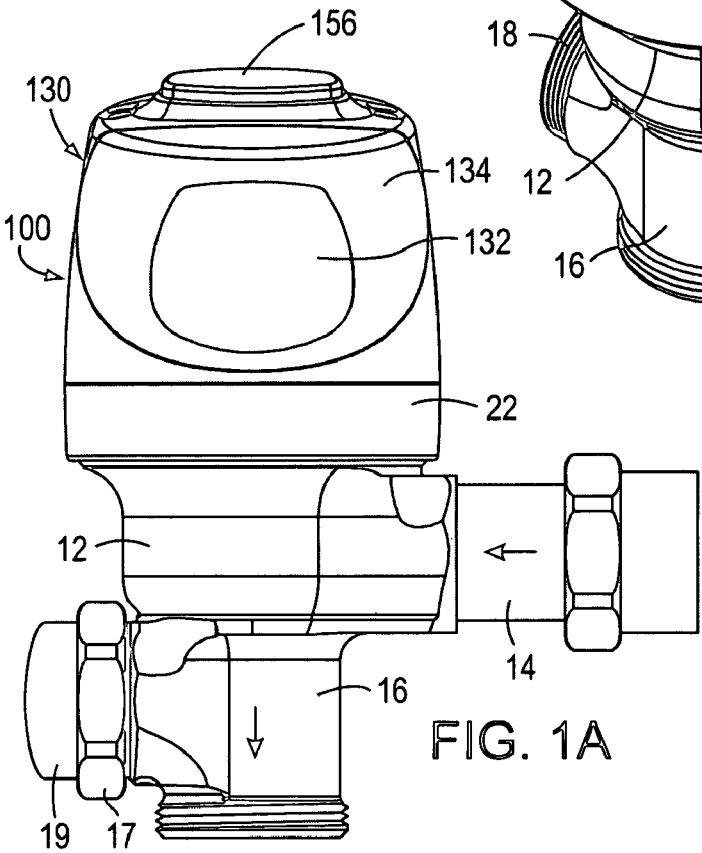

FIG. 1 is a perspective view of an automatic bathroom flusher for flushing toilets or urinals. An automatic bathroom flusher 10 includes a flusher body 12 coupled to a water supply line 14 and also coupled to a water output line 16 providing output to the connected toilet or urinal. Bathroom flusher body 12 is also coupled to a manual port 18, which is used for manual embodiments only. The manual embodiments are described in U.S. Pat. Nos. 3,778,023; 5,881,993; 5,295,655, all of which are incorporated by reference for explanation and better understanding, but are not part of the present invention. The manual flush valves may be converted to automatic flushers using the modules described below. In the automatic flusher design, manual port 18 is closed off using a cap 19 coupled to port 18 using a lock ring 17. FIGS. 1A and 1B are the respective front and top views of bathroom flusher 10 assembled for operation.

Figure 2:
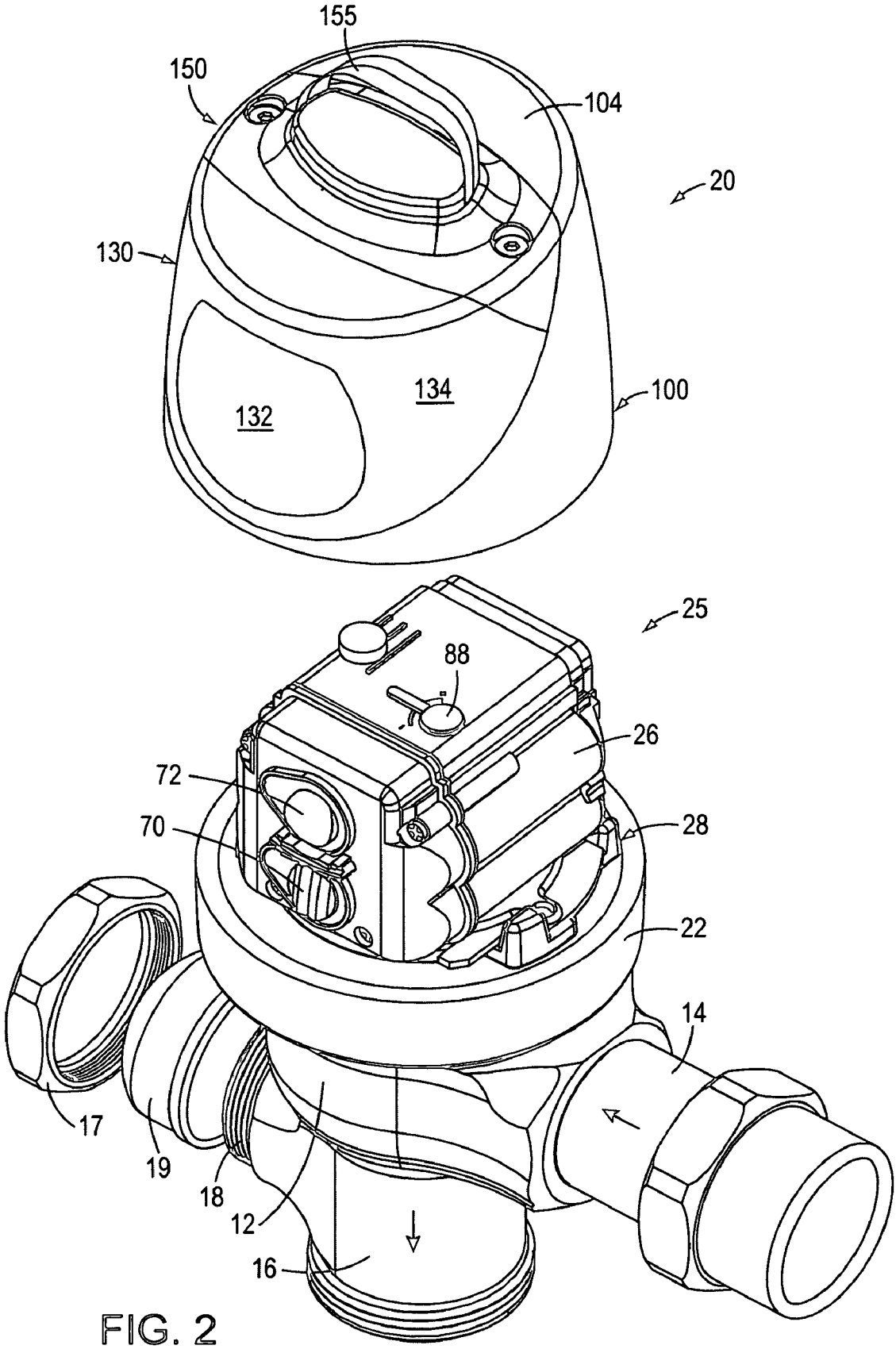
FIG. 2 is a perspective view of the bathroom flusher shown in FIG. 1, having a flusher cover removed.

Automatic bathroom flusher 10 also includes an external flusher cover 20 enclosing electronic control module 25, shown in FIG. 2. External flusher cover 20 is preferably a dome-like outer cover specifically designed for protection and easy servicing of control module 25. Flusher cover 20 also includes a manual override button 156 used to override the flusher's sensor (e.g., an optical sensor, an ultrasonic sensor, a capacitive sensor, a heat sensor or a passive near infrared sensor). Furthermore, flusher cover 20 is designed to protect control module 25 in case of water leaks, as described below.

Figure 2A:
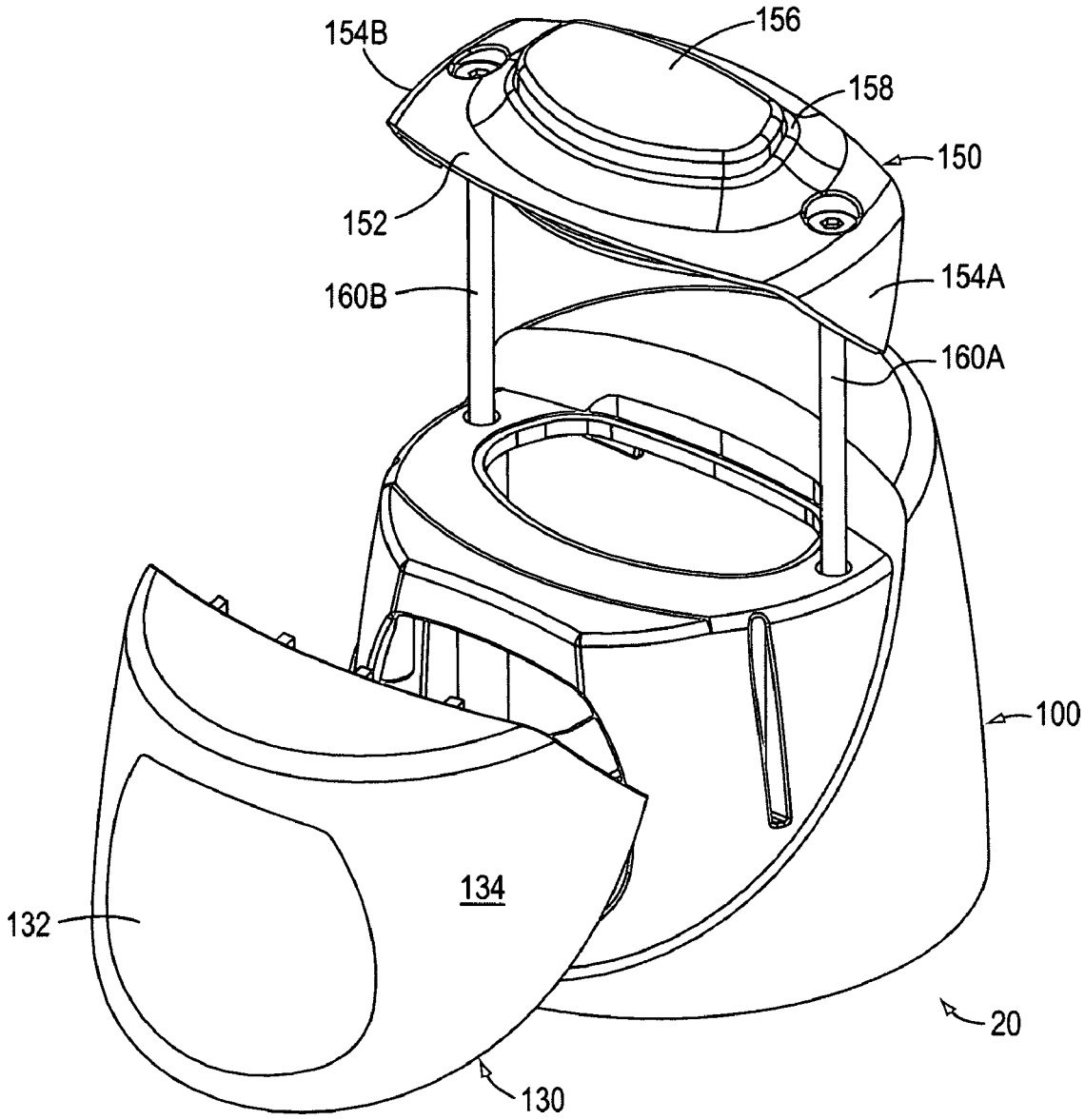
FIG. 2A is a perspective exploded view of the flusher cover shown in FIG. 2.
Figure 3:
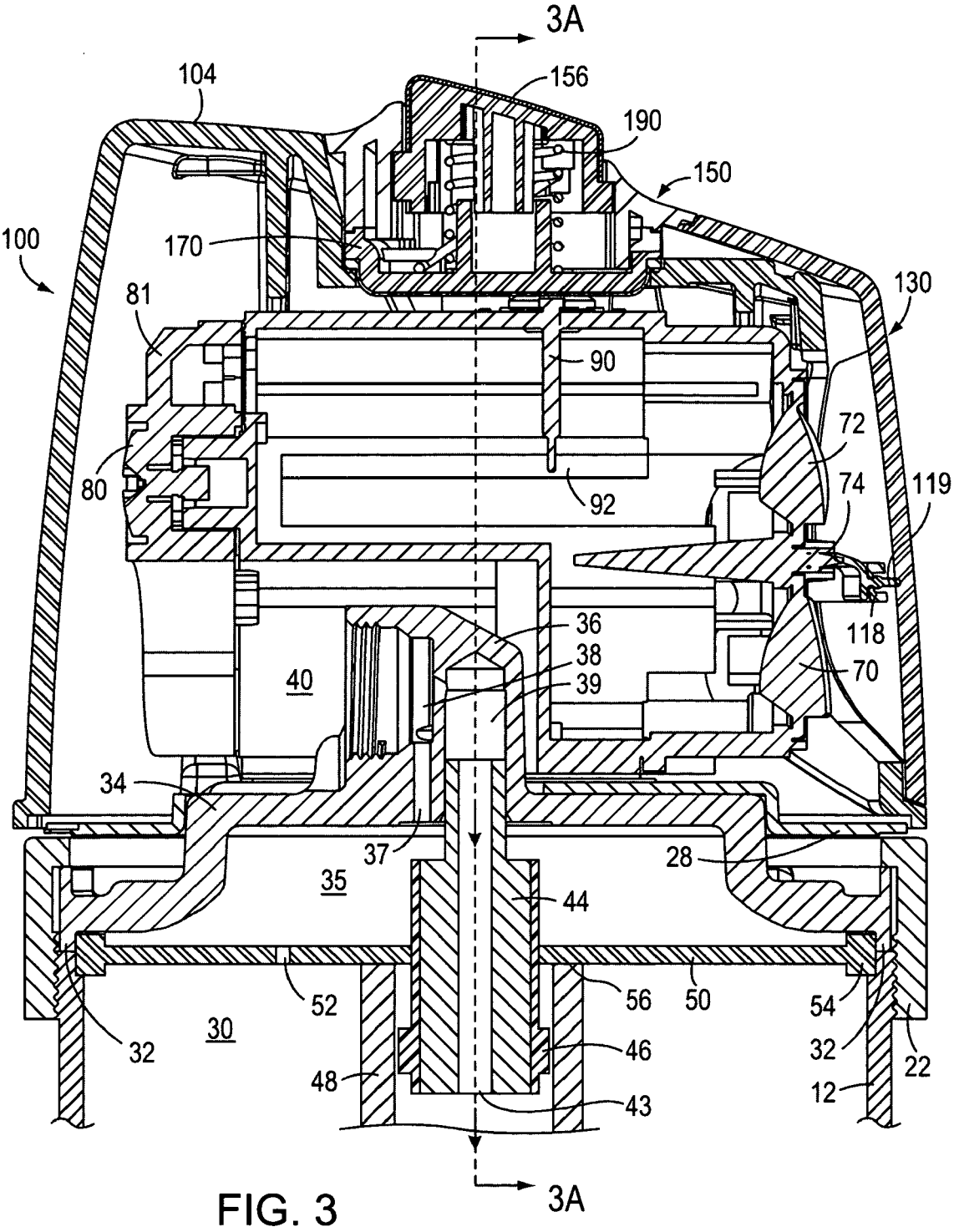
FIGS. 3 and 3A are cross-sectional views of the flusher mainly illustrating an electronic control module and a solenoid actuator located inside of the flusher cover.

As shown in FIGS. 2 and 2A, flusher cover 20 includes a main cover body 100, a front cover 130, and a top cover 150. The entire flusher cover 20 is secured in place with respect to the flusher body using an attachment ring 22 connecting a pilot cap 34 to flusher body 12 (FIG. 3). Electronic control module 25 is positioned onto an alignment plate 28, which defines the module's position and orientation with respect to the front of the flusher. Electronic control module 25 includes electronic elements that control the entire operation of flusher 10, including a sensor and a microcontroller for execution of a detection and flushing algorithm. The microcontroller provides signals to a solenoid driver that in turn provides drive signals to a solenoid actuator 40 (FIG. 3). Solenoid actuator 40 controls the operation of the flush valve assembly that opens and closes water flow from input 14 to output 16. The following description describes this in more detail.

Figure 3A:
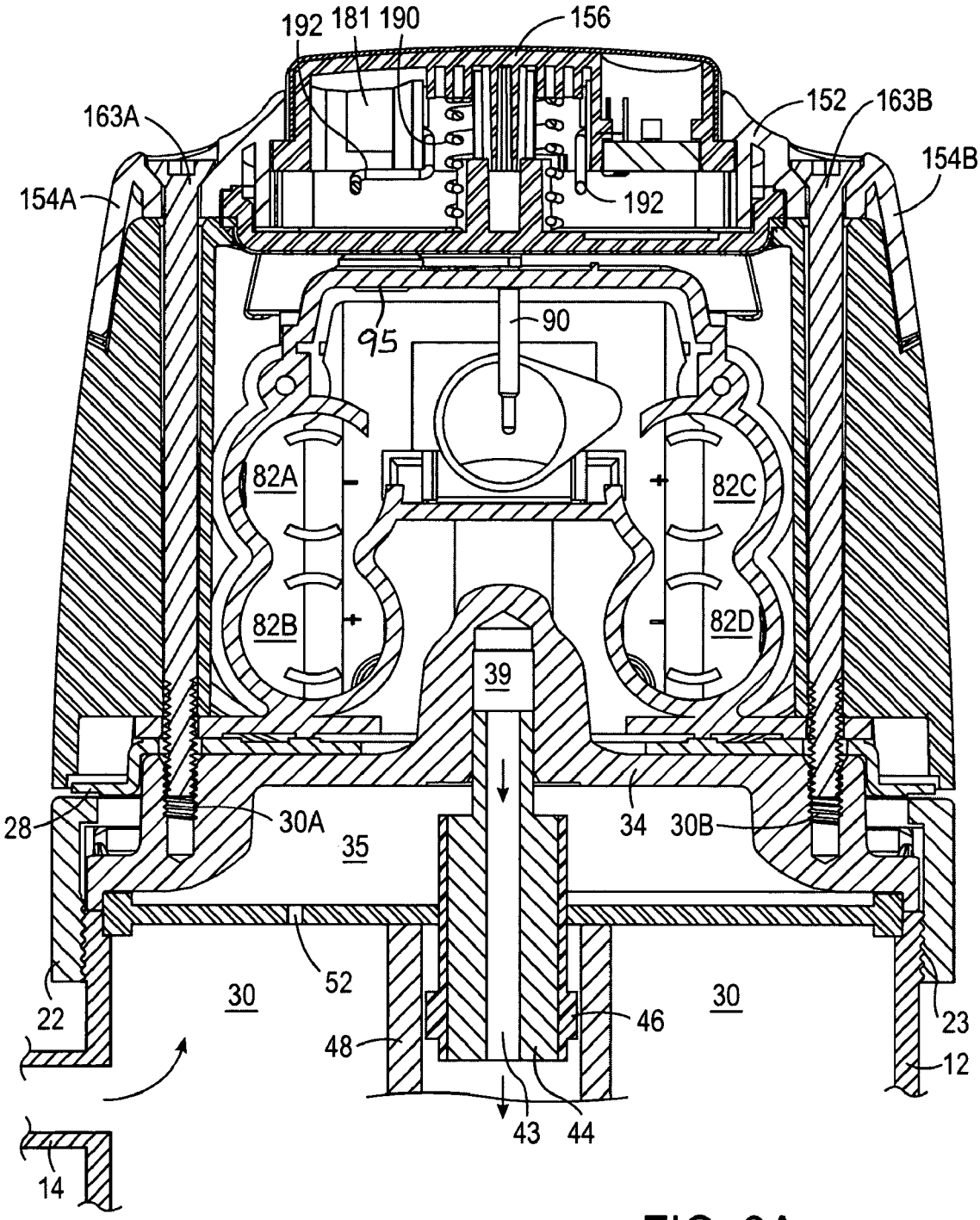

FIGS. 3 and 3A are cross-sectional views illustrating flusher 10 including electronic control module 25 and solenoid actuator 40, all located inside of external cover 20 (FIG. 2). FIGS. 3 and 3A also partially illustrate the top part of flusher body 12 designed to receive the flush valve assembly including a flexible diaphragm 50, and a diaphragm feed-though assembly (which is described, for example, in U.S. Pat. Nos. 6,382,586 and 5,244,179 both of which are incorporated by reference). Electronic control module 25 includes a plastic housing 26 for enclosing batteries, electronic circuitry and a sensor. Preferably, the sensor is an optical sensor that has a light source (i.e., a transmitter) and/or a light detector (i.e., a receiver) operating in the visible to infrared range. Alternatively, the sensor is an ultrasonic sensor or an infrared body heat detector.

Referring still to FIGS. 3 and 3A, the flushing assembly includes pressure cap (pilot chamber cap) 34, flexible diaphragm 50, and a pressure relief assembly coupled to solenoid actuator 40. Flexible diaphragm 50 separates an annular entrance chamber 30 from pilot chamber 35, both being located within valve body 12, wherein a bleed passage 52 provides communication between the two chambers. The pressure relief assembly includes a piloting button 38 coupled to an input passage 37 and an output passage 39 located inside a top part 36 of pilot cap 34.

As described in the PCT application PCT/US02/38758, which is incorporated by reference, piloting button 38 is screwed onto the distal part of actuator 40 to create a valve. Specifically, the plunger of actuator 40 acts onto the valve seat inside piloting button 38 to control water flow between passages 37 and 43. This arrangement provides a reproducible and easily serviceable closure for this solenoid valve. Co-operatively designed with piloting button 38 and actuator 40, there are several O-rings that provide tight water seals and prevent pressurized water from entering the interior of cover 20. The O-rings also seal piloting button 38 within the chamber inside the top part 36 and prevent any leakage through this chamber into the bore where actuator 40 is partially located. It is important to note that these seals are not under compression. The seat member precisely controls the stroke of the solenoid plunger as mentioned above. It is desirable to keep this stroke short to minimize the solenoid power requirements.

Inside cover 20, electronic control module 25 is positioned on alignment plate 28, which in turn is located in contact with pilot chamber cap 34. Plate 28 includes an opening 201 (FIGS. 7 and 7A) designed to accommodate top part 36 of pilot cap 34. Electronic control module 25 includes two circuit boards with control electronics (including preamplifiers and amplifiers for operating the above-mentioned optical sensor), a solenoid driver, and batteries 82A, 82B, 82C and 82D, all of which are located inside plastic housing 26. The light source associated with electronic control module 25 is coupled to an output lens 70 providing light path for the emitted light. A receiver lens 72 focuses received light onto a light detector also located inside plastic housing 26. The operation of the light source and detector and the entire control electronics is described in the PCT application PCT/US02/38758. Another embodiment of the optical sensor is described in U.S. Pat. No. 6,212,697, which is incorporated by reference.

Referring still to FIGS. 3 and 3A, supply line 14 communicates with entrance chamber 30 defined by valve body 12 and a chamber wall 48 formed near the upper end of flush output 16. Flexible diaphragm 50 is seated on a main valve seat 56 formed by the mouth of flush output 16, and has a circularly-shaped outer edge 54 located in contact with the periphery of pilot chamber cap 34. Retaining ring 22 clamps pilot chamber cap 34 at its periphery 32 with respect to flusher body 12, wherein outer edge 54 of diaphragm 50 is also clamped between periphery 32 and flusher body 12.

In the open state, the water supply pressure is larger in entrance chamber 30 than water pressure in pilot chamber 35, thereby unseating the flexible diaphragm 50. When flexible diaphragm 50 is lifted off from seat 56, supply water flows from supply line 14, through the entrance chamber 30 by valve seat 56 into flush conduit 16. In the closed state, the water pressure is the same in entrance chamber 30 and in pilot chamber 35 since the pressure is equalized via bleed hole 52. The pressure equalization occurs when went passage 37 is closed by the plunger of solenoid actuator 40. Then, water pressure in the upper, pilot chamber 35 acts on a larger surface and thus exerts greater force on diaphragm 50 from above than the same pressure within entrance chamber 30, which acts on a smaller, lower surface of diaphragm 50. Therefore, diaphragm 50 ordinarily remains seated on seat 56 (when passage 37 is closed for some time and the pressure equalization occurs).

To flush the toilet, solenoid-operated actuator 40 relieves the pressure in pilot chamber 35 by permitting fluid flow between pilot entrance passage 37 and exit passage 43. The time it takes for the chamber to refill is determined by the stroke of the diaphragm. Furthermore, actuator 40 controls the pressure release time (i.e., time for venting pilot chamber 35), which in turn determines the time during which the flush valve is open for water to pass. Both actuator 40 and the stroke of the diaphragm assembly control the duration of the flush (for a selected size of bleed passage 52) and thus, the volume of water passing through the flush valve. In many regions with a limited water supply, it is very important to closely control the volume of water that passes through the flush valve each time the flusher is operated. Various governments have passed different regulations defining what water flow is permitted through a flush valve in commercial washrooms. A novel design of the actuator and the control electronics can deliver a relatively precise amount of flush water, as described in PCT applications PCT/US02/38758 or PCT/US02/41576, both of which are incorporated by reference.

The design of actuator 40 and actuator button 38 is important for reproducible, long-term operation of flusher 10. Actuator 40 may have its plunger directly acting onto the seat of actuator button 38, forming a non-isolated design where water comes in direct contact with the moving armature of the solenoid actuator. This embodiment is described in U.S. Pat. No. 6,293,516 or U.S. Pat. No. 6,305,662, both of which are incorporated by reference. Alternatively, actuator 40 may have its plunger enclosed by a membrane acting as a barrier for external water that does not come in direct contact with the armature (and the linearly movable armature is enclosed in armature fluid). In this isolated actuator embodiment, the membrane is forced onto the seat of actuator button 38, in the closed position. This isolated actuator, including button 38, are described in detail in PCT application PCT/US 01/51098, which is incorporated by reference.

In general, solenoid actuator 40 includes a bobbin having magnetically wound electrical windings, and an armature linearly movable within the bobbin. The latching versions of the actuator include a ferromagnetic pole piece magnetically coupled to a permanent magnet acting against an armature spring. The permanent magnet is arranged for latching the armature in the open state. The armature spring maintains the armature in the extended position (i.e., the closed position with the plunger preventing flow through passage 37). To flush the toilet, the microcontroller provides a control signal to a drive circuit that provides current to the solenoid windings of actuator 40. The drive current generates a magnetic field that tends to concentrate in a flux path in the ferromagnetic armature and the pole pieces as described in the PCT Application PCT/US01/51098. The latching actuator (i.e., bistable actuator) requires no current to keep the valve open.

In the non-latching versions, there is no permanent magnet to hold the armature in the open position, so a drive current must continue to flow if the pilot valve is to remain open (i.e., the drive current is needed to hold the plunger away from the pilot seat allowing flow through passage 37). The pilot valve can be closed again by simply removing the current drive. To close the pilot valve in the latching actuator, on the other hand, current must be driven through the windings in the reverse direction so that the resultant magnetic field counters the permanent-magnet field that the actuator experiences. This allows the armature spring to re-seat the plunger of actuator 40 in a position in which the spring force is again greater than the magnetic force. Then, the actuator will remain in the pilot-valve-closed position when current drive is thereafter removed.

Referring again to FIG. 2A, external cover 20 is designed for optimal operation and easy servicing of automatic flusher 10. Main cover body 100 provides overall protection and rigidity. Front cover 130 and top cover 150 have complementary shapes with main body 100 to form a dome-like structure and to enable easy disassembly (as shown in FIG. 2A by the exploded view). The main body 100, front cover 130 and top cover 150 fit together like a simple three-dimensional puzzle. In a preferred embodiment, these elements have surfaces arranged to provide a tight water seal. As also shown in FIG. 2A, screws 160A and 160B hold in place top cover 150 by tightening against the respective cooperating threads 30A and 30B located in pilot cap 34. Screws 160A and 160B include respective heads 163A and 163B (FIG. 3A) optionally designed for a unique, custom made wrench (or a screw driver head) that prevents unauthorized removal. This arrangement holds in place and attaches together main cover 100 with front cover 130 and top cover 150, which are all coupled to the pilot chamber cover 34. This arrangement also holds control module 25 and plate 28 in place with respect to pilot cap 34, which in turn is attached to flusher body 12 by a retaining ring 22.

Figure 4:
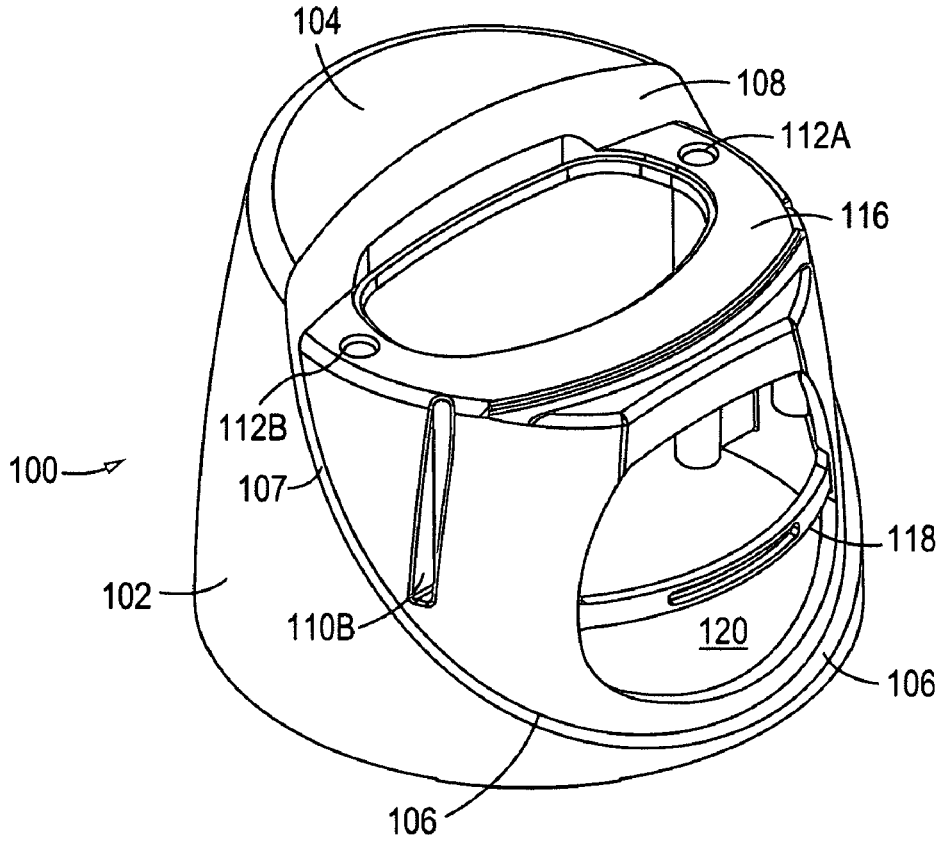
FIG. 4 is a perspective view of a main body of the flusher cover shown in FIG. 2A.
Figure 4A:
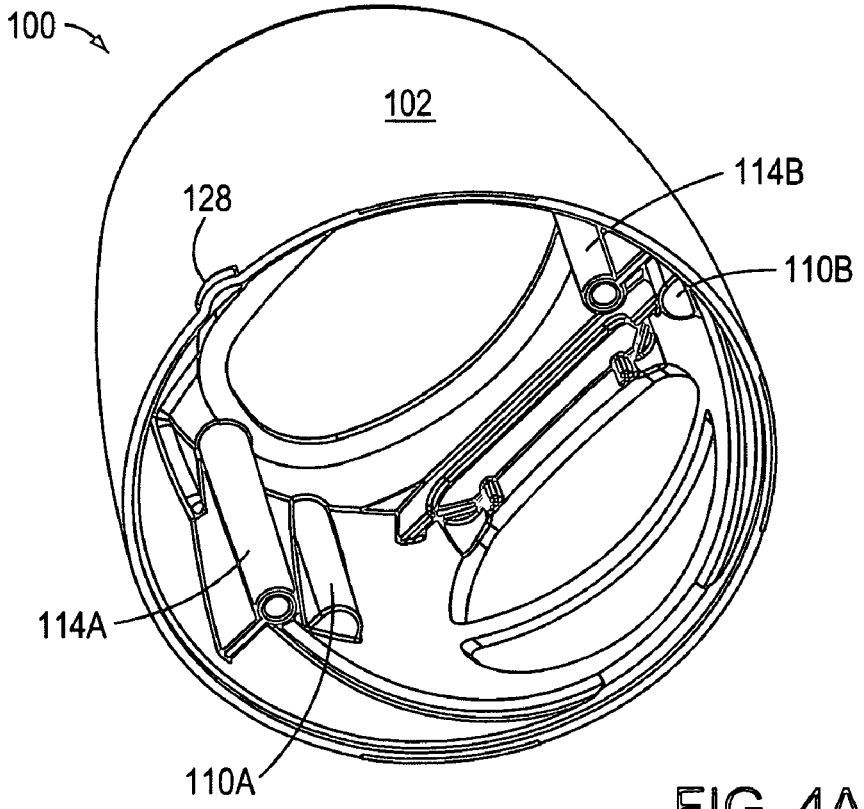
FIG. 4A is a perspective, upside down view of the main body shown in FIG. 4.

FIGS. 4 and 4A are perspective views of main cover body 100. Main body 100 includes a side and rear surface 102 (which has an approximately cylindrical shape), a top surface 104, and an elliptical abutting surface 106 cooperatively arranged with surface 142 of front cover 130 shown in FIG. 5A. Main body 100 also includes an upper side abutting surface 107 cooperatively arranged with the corresponding surface of top cover 150 shown in FIG. 2A. Main body 100 also includes holes 112A and 112B cooperatively arranged with the respective screw guides 114A and 114B for screws 160A and 160B (FIG. 2A) extending from top cover 150 to the respective threaded holes 30A and 30B in pilot cover 34 (FIG. 3A). To attach front cover 130 to main body 100, main body 100 includes slots 110A and 110B cooperatively arranged with lip surfaces 138A and 138B located on the inner side of front cover 130. The rectangular lip surfaces 138A and 138B uniquely define the relative position of main body 100 and front cover 130 and provide relative rigidity.

Still referring to FIGS. 4 and 4A, main body 100 includes a divider element 118 dividing light sensor opening 120 into two parts. The outer side of divider 118 includes a light barrier 119, which prevents cross-talk between source lens 70 and receiver lens 72. The top inner surface 116 of main body 100 is cooperatively arranged with structural alignment elements 140 located on the inside of front cover 130 (FIG. 5A). When assembled, opening 120 is cooperatively arranged with an optical window 132 included in the front surface of front cover 130.

As mentioned above, the optical sensor includes a light source that emits infrared radiation focused by lens 70 through optical window 132. If there is an object nearby, a portion of the emitted radiation is reflected back toward optical window 132. Lens 72 collects and provides a portion of the reflected radiation to the receiver. The receiver provides the corresponding signal to the microcontroller that controls the entire operation of the flush valve.

Figure 4C:
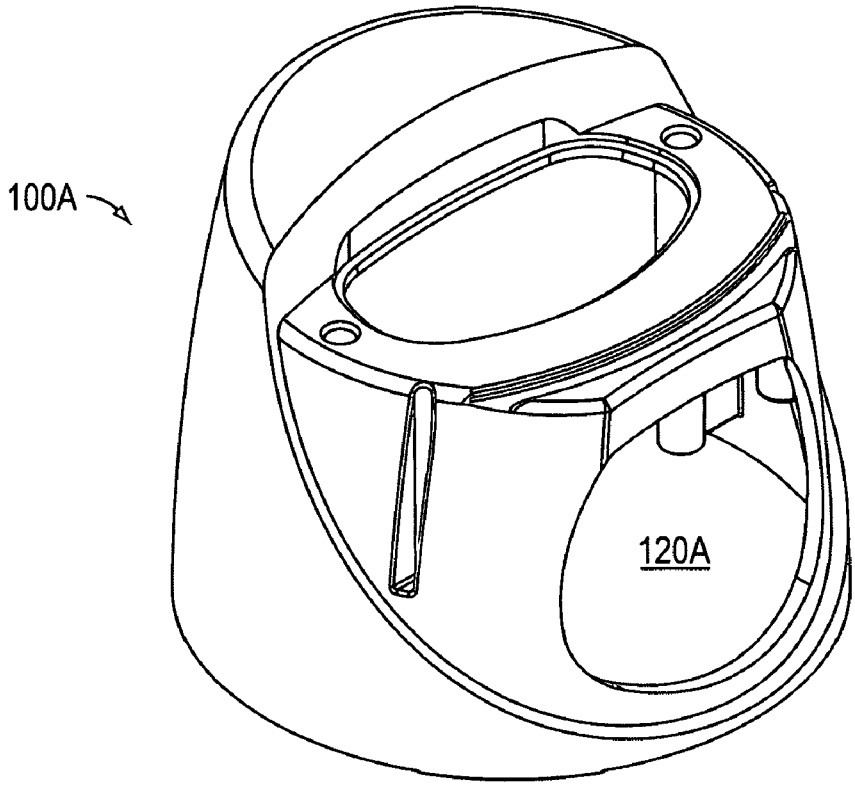
FIG. 4C is a perspective view of another embodiment of the cover main body shown in FIG. 4.

FIG. 4C shows another embodiment of external cover 20 having a main cover body 100A designed for use with front cover 130 and top cover 150. Main cover body 100A has a modified opening 120A used, for example, for an infrared sensor. The infrared sensor is an optical sensor that does not include a light source, but only an infrared detector that senses body heat through optical window 132. Since, in this embodiment, there is no light source, there is no need for divider element 118, which prevents cross-talk between the emitted and detected radiation in the embodiment of FIG. 4A.

Importantly, the material of dome cover 20 is selected to provide protection for electronic control module 25 and actuator 40. Cover 20 is formed of a plastic that is durable and is highly resistant to the chemicals frequently used in washrooms for cleaning purposes. The materials are also highly impact resistant (depending on the type of installation, i.e., public or private) so as to resist attempts of vandalism. Furthermore, flusher cover 20 is designed to replace main cover body 100, front cover 130, or a top cover 150 in cases of vandalism without closing the water supply or removing electronic control module 25. Furthermore, electronic control module 25 may be replaced without closing the water supply.

Main body 100 can alternatively be made of a non-corrosive metal (instead of plastic), while front cover 130 or top cover 150 are still made of plastic. It has been found that polysulfone is a highly desirable plastic material for this purpose. Front cover 130 includes window 132 and can also be made of a polysulfone plastic that does not impede or interfere with the transmission of infrared signals from the sensor. Preferably, window 132 masks or obscures the interior elements in flush valve 10. Preferably, a pigment is added to the polysulfone so that approximately 70 percent of visible light at all wavelengths will pass through window 132 and approximately 30 percent will be impeded. A pigment made by Amoco bearing spec number BK1615 provides a dark (not quite-black), deep lavender window 132, which obscures the interior components, but yet permits transmission of a very substantial portion of light at the used wavelengths. Window 132 is usually made of the same material as other portions of front cover 130, but may be more highly polished in contrast with the somewhat matte finish of the remaining portions of front cover 130. In general, window 132 is made of material suitable for the selected type of the flusher sensor.

Figure 5:
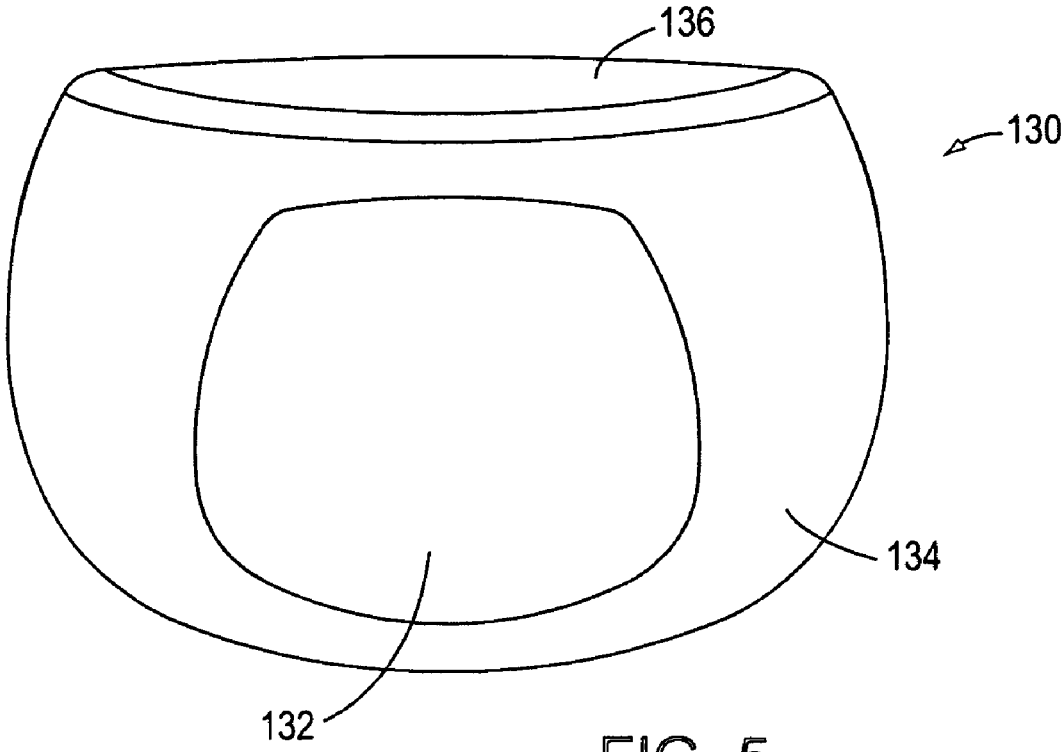
FIGS. 5 and 5A are a front view and a perspective inside view of a front cover removed from the flusher cover, respectively, as shown in FIG. 2A.
Figure 5A:
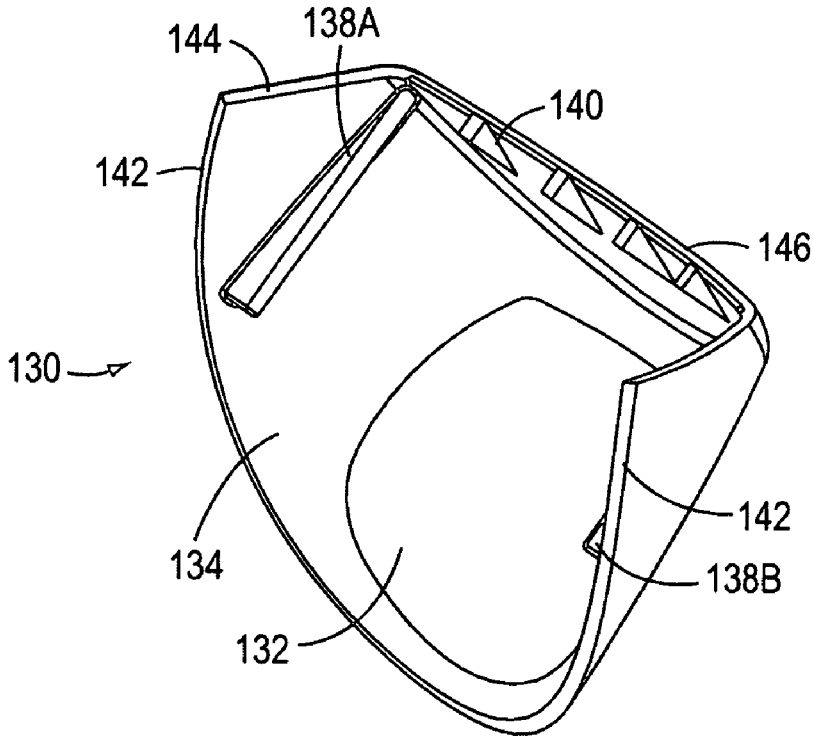
Figure 6:
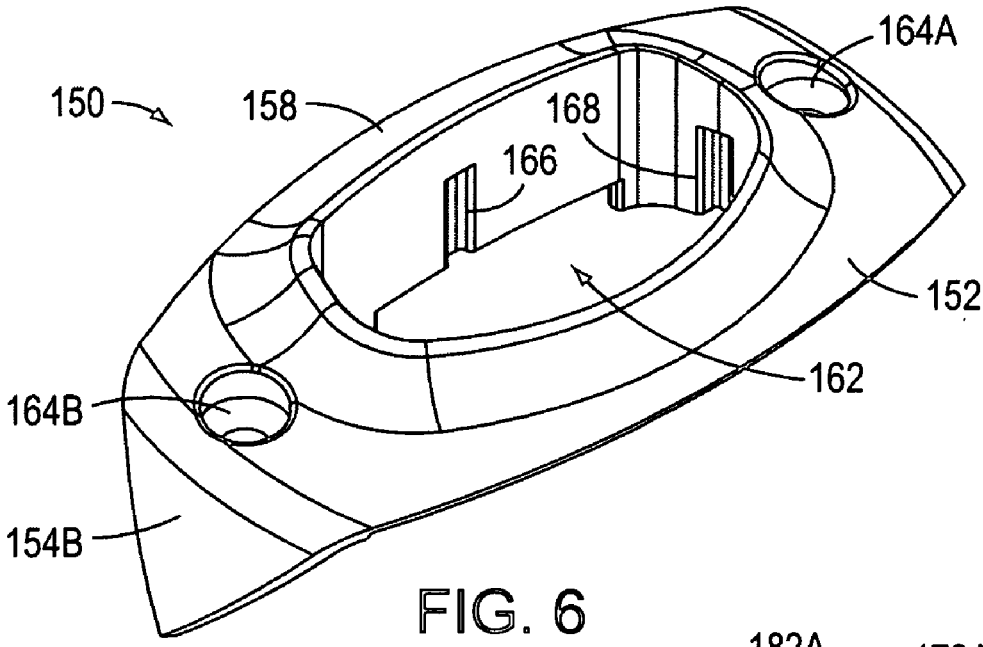
FIG. 6 is a perspective view of a top cover without a button shown in FIG. 2A.
Figure 6A:
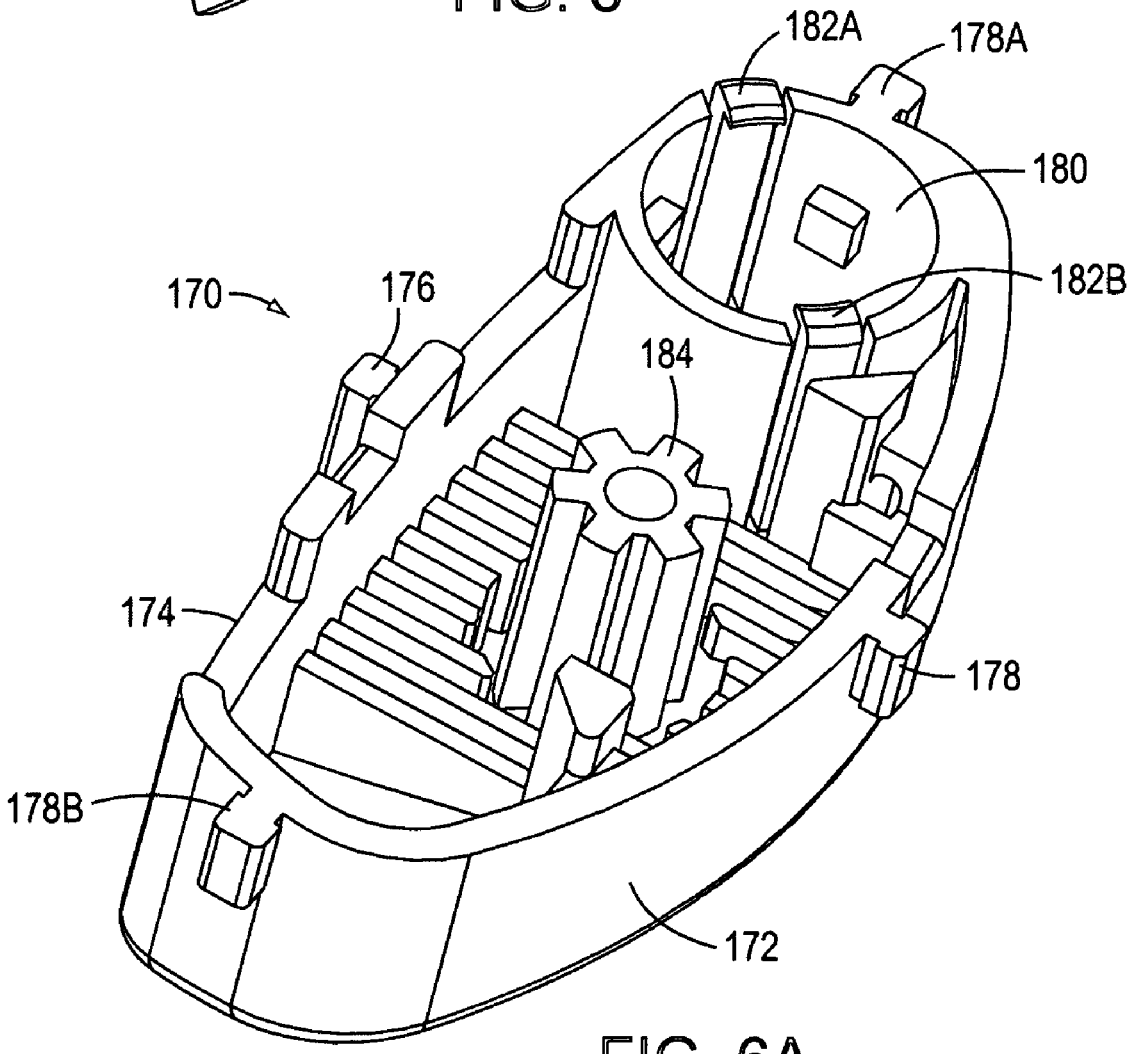
FIG. 6A is a perspective view of a button retainer cooperatively designed to receive the button that is included in the top cover shown in FIG. 6.

Referring to FIGS. 4 and 5, main body 100 is shaped to provide most of the enclosure function of cover 20 including structural support for front cover 130 and top cover 150. Front cover 130 includes optical sensor window 132, a wall member 134, top region 136 and lips or slides 138A and 138B comparatively arranged with grooves 110A and 110B, which are located in the main body 100. After front cover 130 is attached to main body 100 using the lips or slides 138A and 138B, top cover 150 is placed on the top surface 116 of main body 100. Referring also to FIG. 6, top cover 150 includes a curved top surface 158 cooperatively arranged with a button retainer 170 (FIG. 6A) and a button 156 inside hole 162. Top cover 150 also includes side surfaces 154A and 154B, which are functionally important for lifting top cover 150 (after loosening screws 160A and 160B) without any tools.

Figure 4B:
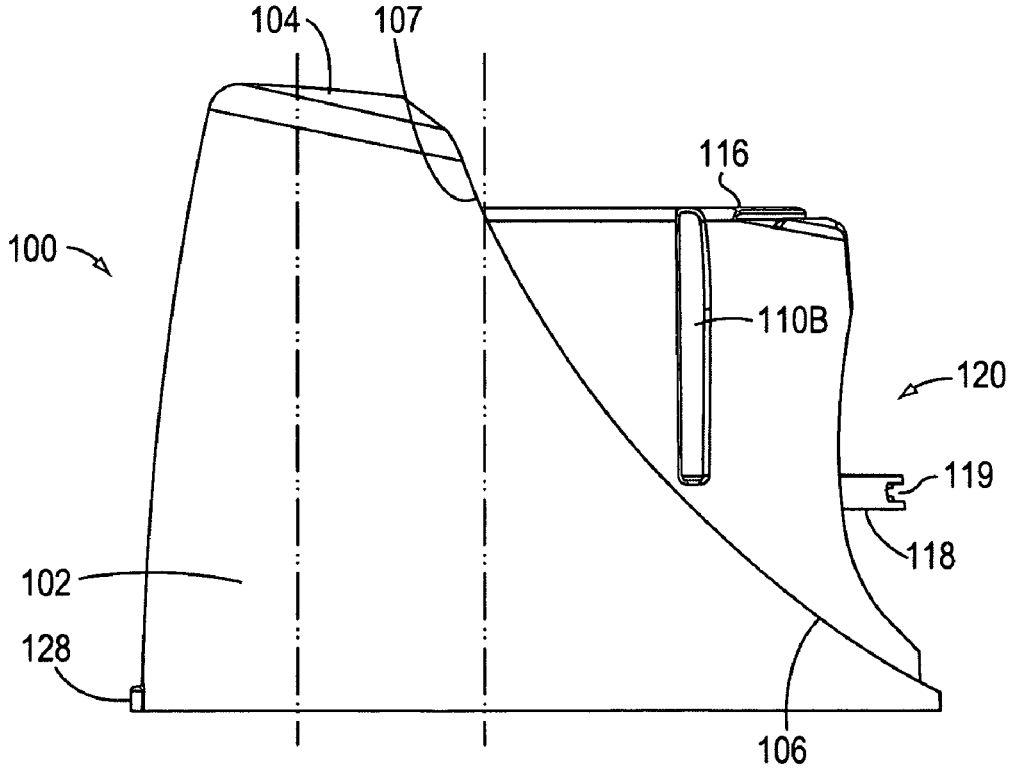
FIG. 4B is a side view of the main body shown in FIG. 4.
Figure 7:
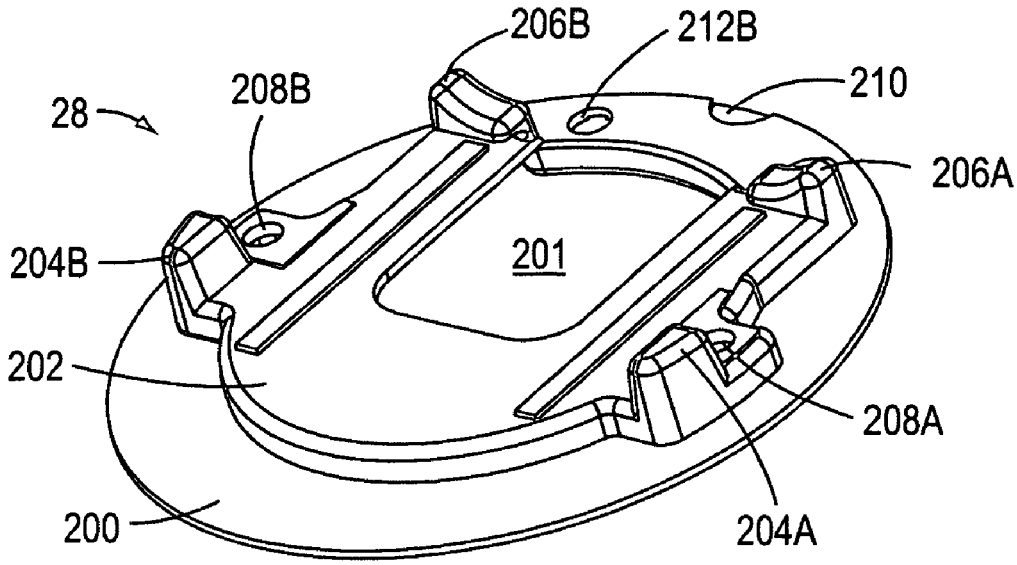
FIG. 7 is a perspective view of an alignment plate designed to receive the electronic control module shown in FIG. 2.
Figure 7A:
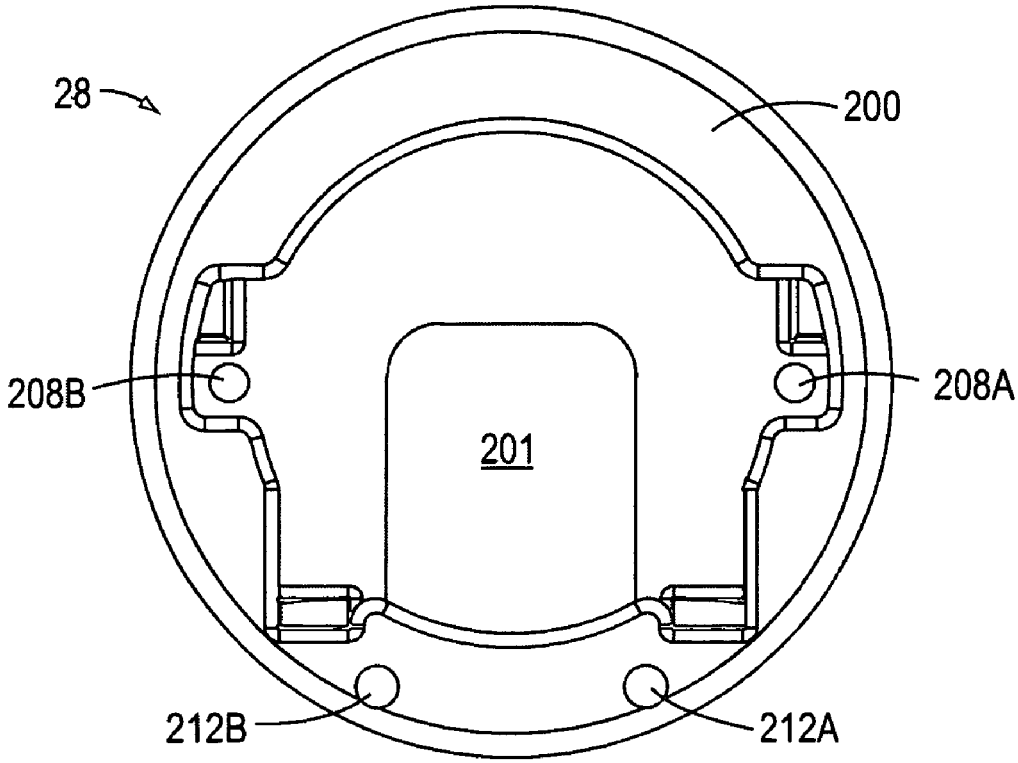
FIG. 7A is a bottom view of the alignment plate shown in FIG. 7.

Referring to FIGS. 7 and 7A, alignment plate 28 includes front alignment posts 204A and 204B, rear alignment posts 206A and 206B, screw holes 208A and 208B, a communication opening 201, and a vent passage 210. Vent passage 210 is cooperatively designed with water passage 128 (FIG. 4B) located in the rear of main body 100. In the case of an unlikely malfunction, there may be a water leak, (for example, between passages 37 and 43) which could create water flow into cover 20. Water passage 128 prevents water accumulation inside the flusher cover 20 and thus prevents flooding and possible damage to electronic module 25. Water passage 128, however, does not allow significant water flow from outside to inside of cover 20 (e.g., from the top or the side of cover 20 during cleaning). This is achieved by the shaped surface of passage 128 and the cooperatively designed passage 201. According to another embodiment, cover 20 is designed to withstand high pressure cleaning, while still providing vent passage 128.

Referring again to FIGS. 6 and 6A, top cover 150 includes main button opening 162, a button insert guide 170 (shown enlarged in FIG. 6A), and two screw holes 164A and 164B. Top cover 150 also includes a top surface 152, two side surfaces 154A and 154B, and a raised surface 158 leading toward an opening 162 for top button 156. Top cover 150 also includes inner alignment surfaces 166 and 168 cooperatively arranged with surfaces 176, 178, 178A and 178B, located on button guide 170. Button insert guide 170 is constructed and arranged to provide a uniform movement of top button 156, which displaces vertically a magnet located inside a cylindrical region 180.

Top cover 150 is designed for accommodating a manual flush and saving batteries (and other electronic elements) during shipping and storage. The manual flush is performed by pressing on top button 156. The saving mode is achieved by holding down top button 156 in the depressed position using a shipping and storage strip 155, as described below. Top button 156 is designed cooperatively with button insert guide 170. Button insert guide 170 includes cylindrical region 180 designed for a magnet 181 that is displaced up and down by the movement of button 156. Magnet 181 is cooperatively arranged with a reed sensor 95 located inside electronic control module 25.

When depressing button 156, reed sensor 95 registers magnet 181 and provides a signal to the microcontroller that in turn initiates a flush cycle, as described in PCT Application PCT/US02/38758, which is incorporated by reference. Upon releasing button 156, button spring 190 (FIGS. 3 and 3A) pushes button 156 to its upper position, and thereby also displaces magnet 181. In the upper position, magnet 181 is no longer sensed by reed sensor 95 (FIG. 3A). The uniform linear movement of button 156 is achieved by using a bail wire 192 in cooperation with spring 190 (FIG. 3A).

Importantly, cover 20 is designed to service automatic flusher 10 without disconnecting the water supply provided via input line 14, or removing retaining ring 22. Top cover 156 can be removed by loosening screws 160A and 160B and lifting top cover 150, as shown in FIG. 2A. Upon lifting top cover 150, front cover 130 may be removed by a sliding upward motion facilitated by grooves 110A and 110B in main body 100. Furthermore, upon removing screws 160A and 160B, the entire cover 20 can be lifted and electronic control module 25 can be accessed. This enables servicing or replacing electronic control module 25 while actuator 40 still remains in place and provides a seal to the external water supply. For example, batteries 82A, 82B, 82C, and 82D may be replaced by removing a screw 80 and a back cover 81 (FIG. 3) to slide the batteries out of body 26 (FIG. 2). After the batteries are replaced, cover 81 is attached back to cover 26 and screw 80 is tightened. Thus, the batteries may be replaced by untrained personnel without any need to call a plumber and closing the external water supply.

Importantly, external cover 20 is designed to adjust the sensitivity of the optical sensor while keeping optical window 132 in place. Specifically, after removing screws 160A and 160B the top cover 150 may be removed by holding side surfaces 154A and 154B. The side surfaces 154A and 154B are designed and arranged for easy removal by fingers of untrained personnel without any need of using a specialized tool. After lifting top cover 150, the top opening in main body 100 provides an access port to an adjustment screw 90 (FIG. 3). Adjustment screw 90 is coupled to an element on a circuit board 92.

A person adjusting the sensitivity of the optical sensor removes top cover 150 and also removes a seal cover 88 located on the top of controller housing 26. Below seal cover 88, there is the head of screw 90, which can be turned in the positive or negative direction to increase or decrease sensitivity of the optical sensor while maintaining front cover 130 and optical window 132 in place. Specifically, according to a preferred embodiment, screw 90 adjusts the resistance value of a current limiting resistor that is connected to the light source. By turning in the positive direction the resistance decreases and the light source receives a higher drive current to increase the emitted light intensity. Thus, the sensitivity of the optical sensor (or an infrared sensor or an ultrasonic sensor) is adjusted under the actual conditions of operation. After the adjustment, seal cover 88 is pushed back onto housing 26 to provide a seal, and top cover 150 is again attached to main cover 100 using screws 160A and 160B.

Importantly, top cover 150 also includes shipping and storage strip 155 (FIG. 2), which is used to maintain a "sleep" mode. Plastic strip 155 is placed and assembled together with button 156 to act against the spring action of spring 190 and hold button 156 in the depressed position. While keeping button 156 in the depressed position, magnet 181 is being sensed by reed sensor 95, which in turn provides a signal to the microcontroller. Upon receiving a continuous signal from the reed sensor over several seconds, the microcontroller is programmed to disable the function of all optical and electronic elements and put them into the "sleep" mode. Therefore, having plastic strip 155 in place, puts the entire electronics of control module 25 into the "sleep" mode and saves batteries. This is used during storage and shipping. Plastic strip 155 is removed by pulling it off upon installation, which enables movement of button 156 and thus enables manual flush actuation.

The above-described electronic control module is designed for easy and time-efficient conversion of manual flush valves (such as ROYAL® flush valves). The entire conversion process takes only few minutes. After the water supply is closed, the manual handle is removed, and lock ring 17 with cover 19 is placed onto manual port 18 (FIG. 2). Then, the original top cover is removed from the manual flusher body. Depending on the model of the manual flusher, the flush valve assembly, including the flexible diaphragm, may also be replaced with diaphragm 50 (and the flushing insert for venting the pilot chamber). Then, the entire cover 20, including electronic control module 25 attached to pilot cap 34 are screwed onto the body 12 using retaining ring 22 acting on threads 23.

Next, plastic strip 155 is removed by pulling action, which causes button 156 to pop up and move magnet 181 into the upper position. Therefore, reed sensor 95 no longer registers magnet 181, and the microcontroller provides a wake-up signal to the individual elements. The water supply can be opened and automatic flusher 10 is ready for operation. As described above, the sensitivity of the optical sensor may be adjusted by removing top cover 150 and changing the power of the source or the sensitivity of the detector while keeping optical window 132 in place.

As described above, the batteries in control module 25 may be replaced without closing the external water supply. Furthermore, the entire control module 25 may be removed and replaced without closing the external water supply. The removed control module 25 can be sent to the factory for refurbishing, which can even be done by untrained personnel. Furthermore, after closing the external water supply, actuator 40 with piloting button 38 may be unscrewed from pilot cap 34. A new actuator and piloting button may be screwed in. The design of actuator 40 and piloting button 38 provide a reproducible geometry for the plunger-seat arrangement. Thus, this design provides a reliable and easily serviceable pilot valve.

According to another embodiment, the flush valve assembly includes a piston valve described in detail in U.S. Pat. No. 5,881,993, which is incorporated by reference. The above-described cover and control unit are also applicable for the piston valve design. Furthermore, the above-described cover and control unit may also be used as a conversion kit for converting manual flushers or utilizing piston valves to automatic flushers using the above-described conversion method.

The invention as claimed herein was made pursuant to a joint research agreement, within the meaning of 35 USC § 103(c). between Arichell Technologies Inc. and Sloan Valve Company, which was in effect on or before the date the claimed invention was made, and the claimed invention was made as a result of activities undertaken within the scope of the joint research agreement.

While the invention has been described with reference to the above embodiments, the present invention is by no means limited to the particular constructions described above and/or shown in the drawings. The present invention also comprises any modifications or equivalents within the scope of the following claims.

The invention claimed is:

1. An automatic toilet room flush valve, comprising:

a valve body including an inlet and an outlet and a valve seat inside said body;

a valve member cooperatively arranged with said valve seat, said valve member being constructed and arranged to control water flow between said inlet and said outlet, movement of said valve member between open and closed positions being controlled by water pressure inside a pilot chamber in communication with a relief passage designed to be opened or closed by an actuator thereby controlling said water pressure;

an external cover defining a cavity designed for enclosing a battery, a sensor and said actuator for controlling operation of said flush valve; and a vent passage for venting water from inside to outside of said cavity defined by said external cover.

2. The flush valve of claim 1 wherein said cover includes a main body part and another removable part.

3. The flush valve of claim 2 wherein said main cover body provides overall rigidity to said external cover.

4. The flush valve of claim 1 wherein said cover includes an optical window, and said sensor is an optical sensor geometrically aligned with said optical window.

5. The flush valve of claim 1 wherein said cover includes a main retaining member and a removable member constructed and arranged to be removed without affecting water pressure in said pilot chamber.

6. The flush valve of claim 5 further constructed to adjust detection sensitivity of said sensor while maintaining said optical window located on said main cover body.

7. The flush valve of claim 5 wherein said removable member is attached with respect to said main retaining member using at least one screw.

8. The flush valve of claim 7 wherein said at least one screw attaches with respect to a pilot cap defining said pilot chamber and being attached to said valve body.

9. The flush valve of claim 1 wherein said cover includes a button constructed to move between upper and lower positions and designed for manually triggering a flush cycle when pushed to said lower position.

10. The flush valve of claim 1 wherein said valve member includes a piston.

11. The flush valve of claim 1 wherein said valve member includes a flexible diaphragm.

12. The flush valve of claim 11 wherein said flexible diaphragm includes a centrally located passage connecting said relief passage and said outlet, said flexible diaphragm being retained with respect to said valve body by a pressure cap defining said pilot chamber.

13. An automatic toilet room flush valve, comprising:

a valve body including an inlet and an outlet and a valve seat inside said body;

a valve member cooperatively arranged with said valve seat, said valve member being constructed and arranged to control water flow between said inlet and said outlet, movement of said valve member between open and closed positions being controlled by water pressure inside a pilot chamber in communication with a relief passage designed to be opened or closed by an actuator thereby controlling said water pressure;

an external cover defining a cavity designed for enclosing a battery, a sensor and said actuator for controlling operation of said flush valve, said external cover including a main cover body, a front cover and a top cover; and a vent passage for venting water from inside to outside of said cavity, said vent passage being defined by said external cover in a manner substantially preventing water from flowing into said cavity.

14. The flush valve of claim 13 wherein said vent passage includes a downward oriented lip defined by said external cover.

15. The flush valve of claim 13 or 14 wherein said main cover body provides overall rigidity to said external cover.

16. The flush valve of claim 13 or 14 wherein said top cover is removable while maintaining said front cover including a sensor window located in place with respect to said main cover body.

17. The flush valve of claim 16 wherein said sensor is an optical sensor and said sensor window includes an optical window.

18. The flush valve of claim 17 further constructed to adjust detection sensitivity of said sensor while maintaining said optical window located on said main cover body.

19. The flush valve of claim 13 or 14 wherein said top cover includes at least one side surface designed for facilitating removal of said top cover.

20. The flush valve of claim 13 or 14 wherein said top cover is attached with respect to said valve body using at least one screw.

21. The flush valve of claim 20 wherein tightening of said at least one screw attaches said main cover body, said front cover, and said top cover to a pilot cap defining said pilot chamber and being attached to said valve body.

22. The flush valve of claim 13 or 14 wherein said top cover includes a button constructed to move between upper and lower positions and designed for manually triggering a flush cycle when pushed to said lower position.

23. The flush valve of claim 13 or 14 wherein said valve member includes a piston.

24. The flush valve of claim 13 or 14 wherein said valve member includes a flexible diaphragm.

25. The flush valve of claim 24 wherein said flexible diaphragm includes a centrally located passage connecting said relief passage and said outlet, said flexible diaphragm being retained with respect to said valve body by a pressure cap defining said pilot chamber.

* * * * *